US011184716B2

(12) United States Patent
Rufenacht et al.

(10) Patent No.: US 11,184,716 B2
(45) Date of Patent: Nov. 23, 2021

(54) SIDE SPECIFIC BEHIND-THE-EAR HEARING DEVICE AND BINAURAL HEARING SYSTEM INCLUDING THE SAME

(71) Applicant: SONOVA AG, Staefa (CH)

(72) Inventors: Marius Rufenacht, Volketswil (CH); Richard Niccolai, Uster (CH); Petra Gunde, Stäfa (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/510,790

(22) Filed: Jul. 12, 2019

(65) Prior Publication Data

US 2021/0014620 A1 Jan. 14, 2021

(51) Int. Cl.
*H04R 25/00* (2006.01)
*H04R 25/02* (2006.01)

(52) U.S. Cl.
CPC ..... *H04R 25/552* (2013.01); *H04R 25/02* (2013.01); *H04R 25/607* (2019.05); *H04R 25/554* (2013.01)

(58) Field of Classification Search
CPC .... H04R 25/552; H04R 25/607; H04R 25/02; H04R 25/554; H04R 2225/0213
See application file for complete search history.

(56) References Cited

U.S. PATENT DOCUMENTS 6,193,368 B1 * 2/2001 George ..... G02C 5/00 351/111
7,013,014 B2 3/2006 Ach-Kowalewski et al.
8,878,735 B2 11/2014 Kvist et al.
2007/0014423 A1 * 1/2007 Darbut ..... H04R 25/65 381/330
2009/0074221 A1 * 3/2009 Westermann ..... H04R 25/65 381/327
2012/0057735 A1 * 3/2012 Meier ..... H04R 25/65 381/330
2013/0265538 A1 * 10/2013 Osei-Agyeman ..... G02C 5/143 351/111
2019/0101977 A1 * 4/2019 Armstrong-Muntner ..... G06F 3/012

FOREIGN PATENT DOCUMENTS

DE 19908194 2/1999

* cited by examiner

*Primary Examiner* — Ping Lee
(74) *Attorney, Agent, or Firm* — ALG Intelectual Property, LLC

(57) ABSTRACT

An exemplary behind-the-ear ("BTE") hearing device has a side specific structure and includes a housing comprising: a proximal portion configured to be positioned towards an upper part of an ear of a recipient, the proximal portion having a curved shape configured to curve within a first reference plane such that the proximal portion is configured to follow a median shape of the ear when the BTE hearing device is worn by the recipient; and a distal portion configured to extend behind the ear when the BTE hearing device is worn by the recipient, the distal portion configured to extend within a second reference plane that intersects the first reference plane at an angle such that the distal portion is bent with respect to the proximal portion and is configured to extend toward a skull of the recipient when the BTE hearing device is worn by the recipient.

15 Claims, 14 Drawing Sheets

SIDE SPECIFIC BEHIND-THE-EAR HEARING DEVICE AND BINAURAL HEARING SYSTEM INCLUDING THE SAME

BACKGROUND INFORMATION

A binaural hearing system includes two hearing devices (e.g., hearing aids), one for each ear. Binaural hearing systems often provide users with improved sound quality, perception, and localization compared to monaural hearing device configurations.

The hearing devices such as those used in binaural hearing systems are typically symmetrically formed such that a hearing device can be used interchangeably behind either the left ear or the right ear of a user. Such a configuration is beneficial in that it results in operational efficiencies due to scaling effects and lower initial costs. However, hearing devices configured in such a manner may easily fall off the ear, may be too short for proper retention behind the ear, may be uncomfortable to wear with other accessories (e.g., glasses, helmets, etc.), and/or may be uncomfortable to wear while the user sleeps.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

DETAILED DESCRIPTION

A side specific BTE hearing device and binaural hearing system including the same are described herein. As will be described in more detail below, an exemplary BTE hearing device that has a side specific structure includes a housing comprising: a proximal portion configured to be positioned towards an upper part of an ear of a recipient, the proximal portion having a curved shape configured to curve within a first reference plane such that the proximal portion is configured to follow a median shape of the ear when the BTE hearing device is worn by the recipient; and a distal portion configured to extend behind the ear when the BTE hearing device is worn by the recipient, the distal portion configured to extend within a second reference plane that intersects the first reference plane at an angle such that the distal portion is bent with respect to the proximal portion and is configured to extend toward a skull of the recipient when the BTE hearing device is worn by the recipient.

By configuring a BTE hearing device to have a side specific structure, it is possible to improve how comfortable the BTE hearing device is to wear. For, example, BTE hearing devices such as those described herein improve comfortability while worn with other accessories (e.g., glasses) and/or improve comfortability while worn when the recipient's head is laying against another object (e.g., while sleeping). In addition, BTE hearing devices such as those described herein are configured to facilitate retention behind the ear of the recipient such that the BTE hearing devices are less likely to fall off. Moreover, because BTE hearing devices such as those described herein have a side specific structure, they are configured to fit the skull of the recipient better than conventional BTE hearing devices. As such, BTE hearing devices such as those described herein may be more aesthetically appealing than conventional BTE hearing devices. Other benefits of the BTE hearing devices and systems described herein will be made apparent herein.

Figure 1:
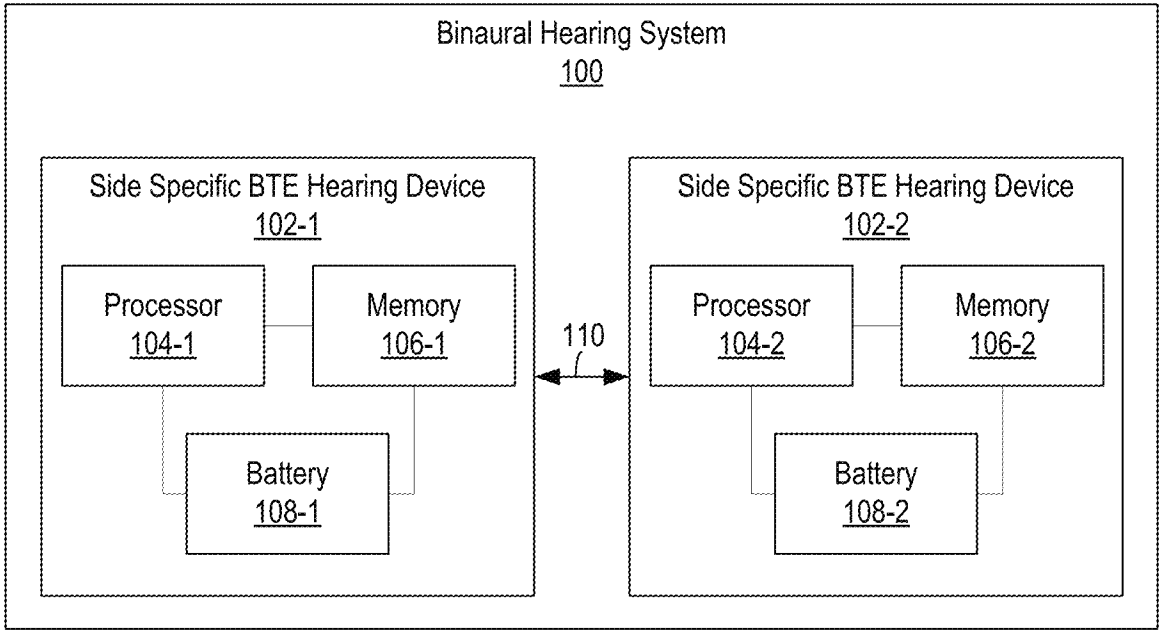
FIG. 1 illustrates an exemplary binaural hearing system according to principles described herein.

In certain examples, BTE hearing devices such as those described herein may be implemented as part of a binaural hearing system. As such, FIG. 1 illustrates an exemplary binaural hearing system 100 that includes a first side specific BTE hearing device 102-1 and a second side specific BTE hearing device 102-2 (collectively "BTE hearing devices 102"). BTE hearing devices 102 are referred to herein as having a "side specific" structure because they are each configured to fit only behind a particular ear of a recipient. For example, BTE hearing device 102-1 may be configured to only fit behind a left ear of a recipient and BTE hearing device 102-2 may be configured to only fit behind a right ear of the recipient. Exemplary side specific structures of BTE hearing devices are described herein. Each element shown in binaural hearing system 100 will now be described in detail.

BTE hearing devices 102 may each be implemented by any type of hearing device configured to provide or enhance hearing to a recipient of binaural hearing system 100. For example, BTE hearing devices 102 may be implemented by a hearing aid configured to amplify audio content to a recipient, a sound processor included in a cochlear implant system configured to apply electrical stimulation representative of audio content to a recipient, a sound processor included in a stimulation system configured to apply electrical and acoustic stimulation to a recipient, or any other suitable hearing prosthesis. In some examples, BTE hearing device 102-1 may be of the same type as BTE hearing device 102-2. For example, BTE hearing devices 102 may each be hearing aid devices. In certain alternative examples, BTE hearing device 102-1 may be of a different type than BTE hearing device 102-2. For example, BTE hearing device 102-1 may be a hearing aid and BTE hearing device 102-2 may be a sound processor included in a cochlear implant system. Exemplary side specific BTE hearing devices are described herein.

As shown, each BTE hearing device 102 includes a processor, memory, and a battery (among other components). For example, BTE hearing device 102-1 includes processor 104-1, memory 106-1, and battery 108-1. Likewise, BTE hearing device 102-2 includes processor 104-2, memory 106-2, and battery 108-2.

Processors 104 are configured to perform any suitable processing operation that may be associated with BTE hearing devices 102. For example, when one of BTE hearing devices corresponds to a hearing aid device, such processing operations may include monitoring ambient sound, connecting to an external device (e.g., a smartphone, a television, etc.), and/or representing sound to a recipient via an in-ear microphone. In examples where one or more of BTE hearing devices 102 are included as part of a cochlear implant system, such processing operations may include directing a cochlear implant to generate and apply electrical stimulation representative of one or more audio signals (e.g., one or more audio signals detected by a microphone, input by way of an auxiliary audio input port, etc.) to one or more stimulation sites associated with an auditory pathway (e.g., the auditory nerve) of a recipient. Processors 104 may each be implemented by any suitable combination of hardware and software.

Memory 106 may be implemented by any suitable type of storage medium and may maintain (e.g., store) data utilized by processors 106. For example, memory 106 may store data representative of an operation program that specifies how each processor 104 processes and delivers audio content to a recipient. To illustrate, memory 106-1 may maintain data representative of a first program that causes processor 104-1 to operate in a wireless audio rendering mode and a second program that causes processor 104-2 to operate in a normal mode in which processor 104-2 amplifies ambient sound detected by a microphone that is a part of BTE hearing device 102-1. Memory 106-2 may maintain data representative of similar programs.

Battery 108-1 is configured to provide operating power for processor 104-1, memory 106-1, and/or other components included in BTE hearing device 102-1. Likewise, battery 108-2 is configured to provide operating power for processor 104-2, memory 106-2, and/or other components included in BTE hearing device 102-2. In some examples, batteries 108 are rechargeable. Alternatively, batteries 108 are non-rechargeable. Batteries 108 may have any suitable capacity, discharge profile, and/or other characteristic as may serve a particular implementation.

BTE hearing devices 102 may communicate with each other (e.g., by transmitting data) by way of a binaural communication link 110 that interconnects hearing devices 104. Binaural communication link 110 may include any suitable wireless or wired communication link as may serve a particular implementation.

Figure 2A:
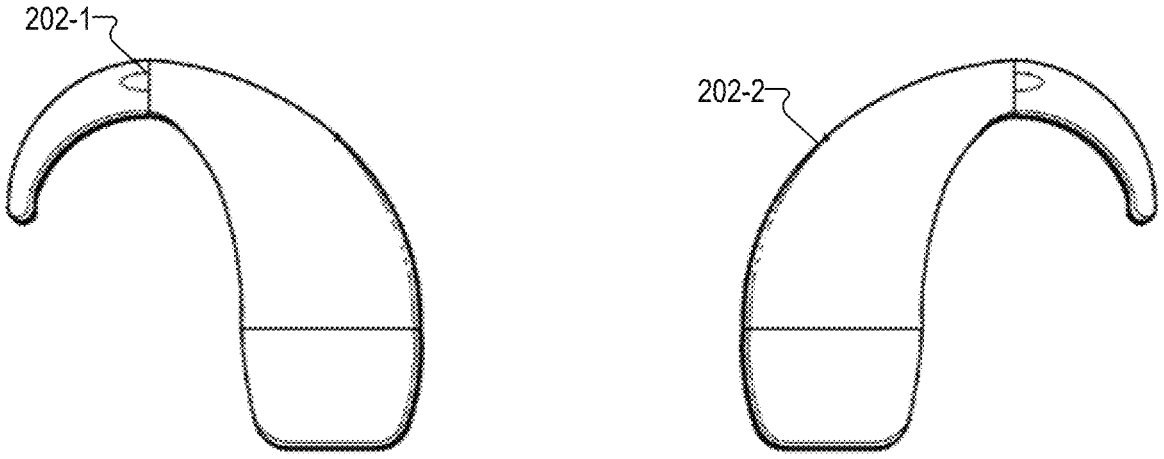
Fig. 2A (Prior Art)
FIGS. 2A and 2B illustrate exemplary conventional behind-the-ear ("BTE") hearing devices.
Figure 2B:
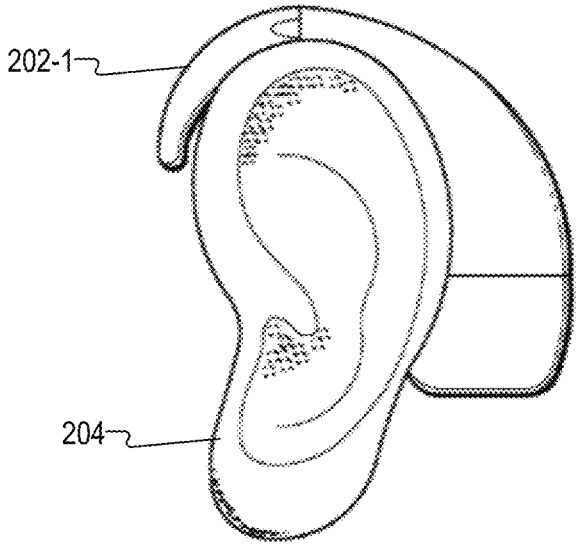
Fig. 2B (Prior Art)

As mentioned, BTE hearing devices 102 are configured to have a side specific structure, which is different from conventional hearing devices that are not side specific. To illustrate, FIGS. 2A and 2B show exemplary conventional hearing devices 202 (e.g., conventional hearing devices 202-1 and 202-2). As shown in FIG. 2A, conventional hearing devices 202 are symmetrical in shape. As such, conventional hearing device 202-1 may be provided (e.g., worn) behind a left ear 204 of a recipient, as shown in FIG. 2B, or may alternatively be provided behind a right ear (not shown) of the recipient. Similarly, conventional hearing device 202-2 may be provided interchangeably behind either the left ear or the right ear of the recipient.

Figure 3:
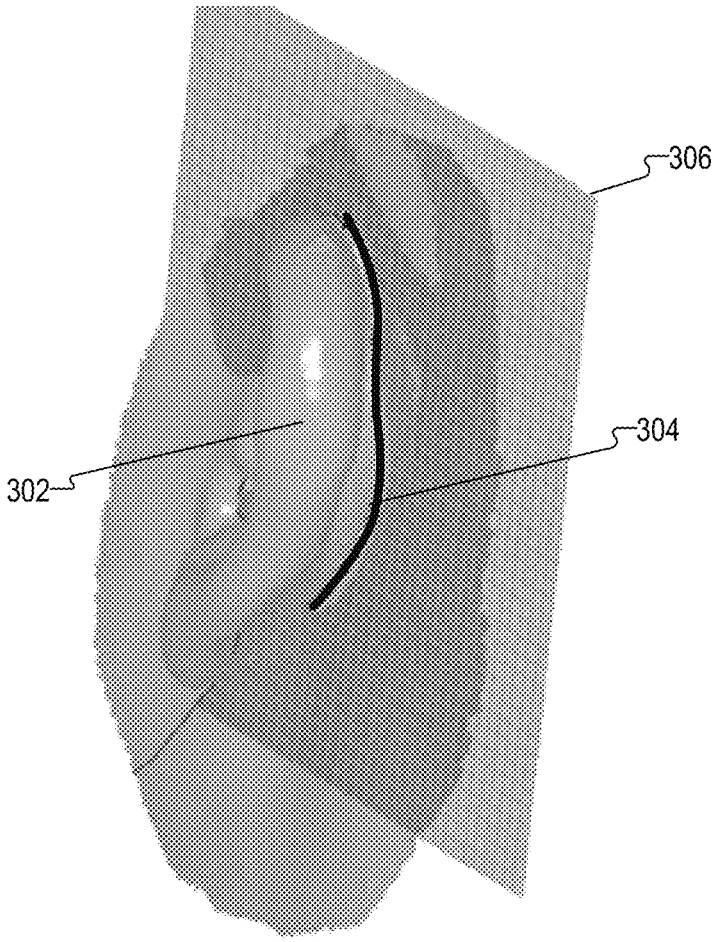
FIG. 3 illustrates an exemplary median shape of a left ear of a recipient according to principles described herein.

In contrast to conventional hearing devices such those shown in FIGS. 2A and 2B, BTE hearing devices such as those described herein are configured to be worn behind a specific ear of a recipient. The side specific structure of a BTE hearing device corresponds to the shape of BTE hearing device, which is defined by the median shape (also referred to as the "saddle curve") behind the pinna of the ear and the space between the helix of the ear and the skull of the recipient. As used herein, a "median shape" of the ear refers to the curvature of the ear behind the pinna from the uppermost portion where the pinna attaches to the head of the recipient downward in the space between the helix of the ear and the earlobe. To illustrate, FIG. 3 shows the pinna 302 of a left ear of a recipient and an exemplary median shape 304, which is represented by a thick black line in FIG. 3 for illustrative purposes. In FIG. 3, a grid 306 represents a reference plane in which median shape of the left ear curves.

Figure 4:
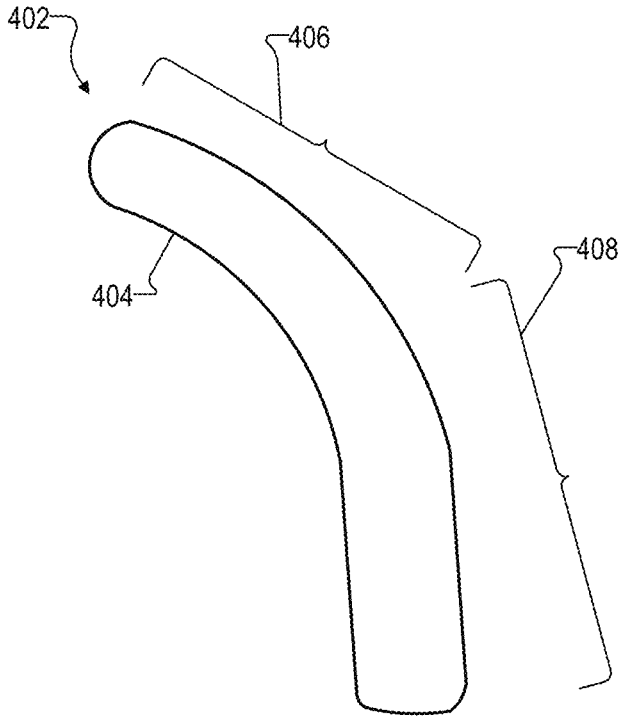
FIG. 4 illustrates a side view of an exemplary BTE hearing device according to principles described herein.

BTE hearing devices such as those described herein are configured to have a curvature that follows the median shape (e.g., median shape 304) of a particular ear of a user. To illustrate, FIG. 4 shows a side view of an exemplary BTE hearing device 402 that has a side specific structure such that BTE hearing device 402 is configured to be worn behind a left ear of a recipient. BTE hearing device 402 may be implemented in a binaural hearing system (e.g., binaural hearing system 100) or may be implemented as a standalone device (e.g., a hearing device that does not operate in conjunction with or communicate with another BTE hearing device).

As shown in FIG. 4, BTE hearing device 402 includes a housing 404 that includes a proximal portion 406 and a distal portion 408. BTE hearing device 402 shown in FIG. 4 is a simplified depiction of a side specific BTE hearing device. It is understood that BTE hearing device 402 may have additional components (not shown) in other implementations. For example, BTE hearing device 402 may include a microphone assembly, one or more ports to connect to other devices (e.g., a cochlear implant headpiece, an external audio source, etc.), one or more buttons to facilitate controlling BTE hearing device 402, and/or any other suitable additional component.

Proximal portion 406 of housing 404 is configured to be positioned towards an upper part of an ear of a recipient when worn by the recipient. For example, proximal portion 406 is configured to be positioned adjacent to the uppermost portion where the pinna of the ear attaches to the head of the recipient. As shown in FIG. 4, proximal portion 406 has a curved shape that is configured to curve within a first reference plane that is parallel to the page of the paper in the illustration shown in FIG. 4. With the curved shape, proximal portion 406 is configured to follow the median shape (e.g., median shape 304) of the ear when the BTE hearing device is worn by the recipient.

In certain examples, the curved shape of a proximal portion of a BTE hearing device may be configured to match the median shape of a particular ear of the recipient. For example, the proximal portion may have a curved shape that matches median shape 304 shown in FIG. 3. In such examples, the curved shape may be selected based on an average or typical median shape associated with left or right ears of a plurality of recipients. Alternatively, the curved shape may be customized so as to match a median shape of a particular ear of a specific recipient.

Figure 5:
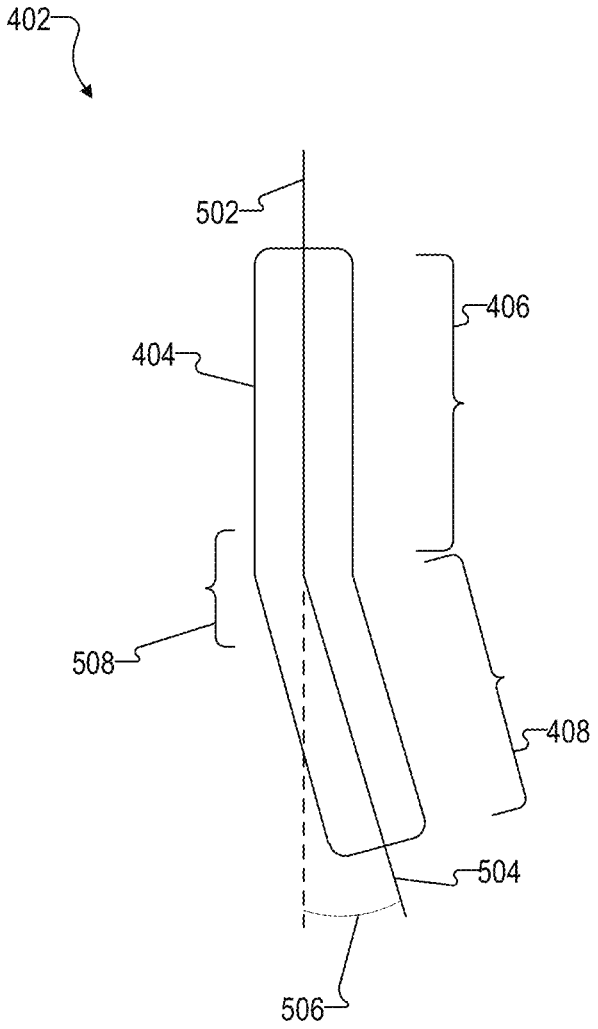
FIG. 5 illustrates a rear view of the exemplary BTE hearing device shown in FIG. 4 according to principles described herein.

Distal portion 408 of housing 404 is configured to extend behind the ear when BTE hearing device 402 is worn by the recipient. Distal portion 408 is further configured to extend within a second reference plane that intersects the first reference plane at an angle. To illustrate, FIG. 5 shows a back view of BTE hearing device 402. As shown in FIG. 5, proximal portion 406 extends within a first reference plane 502 that is perpendicular to the face of the page showing FIG. 4. On the other hand, distal portion 408 extends within a second reference plane 504 that intersects first reference plane 502. In the example shown in FIG. 5, second reference plane 504 also is perpendicular to the face of the page showing FIG. 5 but is provided at an angle 506 with respect to first reference plane 502. With such a configuration, distal portion 408 is bent or angled with respect to proximal portion 406 and is configured to extend toward a skull of the recipient when BTE hearing device 402 is worn by the recipient.

Angle 506 may have any suitable value as may serve a particular implementation. In certain examples, angle 506 may be greater than 0° and less than 20°. In certain other examples, angle 506 may be greater than 0° and less than 10°. In certain other examples, angle 506 may be greater than or equal to 3° and less than or equal to 9°.

In certain examples, BTE hearing device 402 may be sized such that the entire BTE hearing device 402 fits behind the left ear of the recipient. As such, when the recipient is viewed from the left side, the BTE hearing device 402 is not visible to another individual.

In certain examples, an angle at which a distal portion of a housing is bent with respect to a proximal portion may be repeatably adjustable. To that end, in certain examples, a housing of a BTE hearing device may include a bendable portion where the distal portion of the housing is configured to bend with respect to the proximal portion. For example, such a bendable portion may be bent to a first position where the distal portion is provided at a first angle with respect to the proximal portion. Afterwards, the bendable portion may be bent again such that the distal portion is provided at a second angle with respect to the proximal portion. The second angle may be less than or greater than the first angle. Such a bendable portion may be bent any suitable number of times to facilitate customizing the angle at which the distal portion of a housing is bent with respect to the proximal portion. In the exemplary BTE hearing device 402 shown in FIG. 5, a portion 508 may correspond to such a bendable portion.

To facilitate a distal portion of a housing bending with respect to a proximal portion, at least a part of the housing may be formed of a deformable material configured to bend and remain in position. Any suitable material may be used for a bendable portion as may serve a particular implementation. For example, at least a portion of the housing may be formed of a thermoplastic that is configured to become bendable at a certain temperature and solidify upon cooling.

Figure 6:
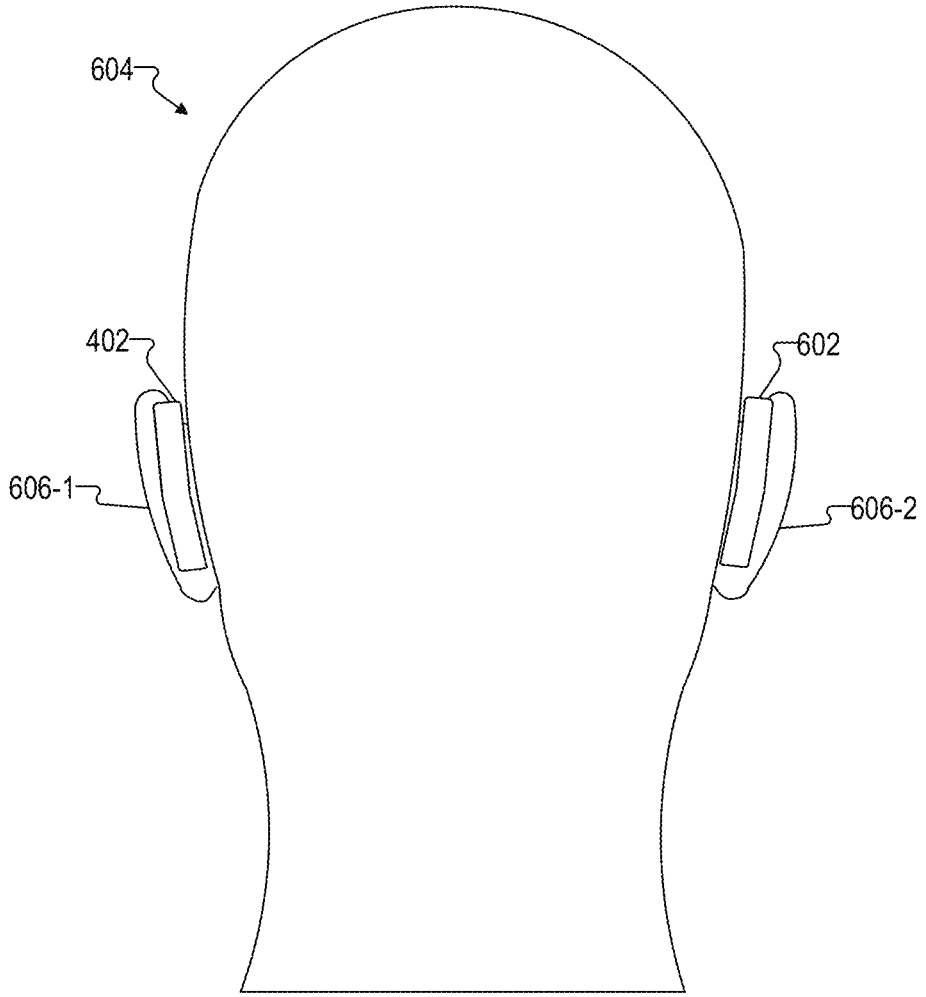
FIG. 6 illustrates a rear view of a head of a recipient that is wearing exemplary BTE hearing devices that are configured according to principles described herein.

FIG. 6 illustrates a rear view showing BTE hearing device 402 and an additional BTE hearing device 602 as they would appear when worn on a head 604 of a recipient. As shown in FIG. 6, BTE hearing device 402 has a side specific structure and is configured to be worn behind a left ear 606-1 of the recipient. Because BTE hearing device 402 is provided in a bent configuration, BTE hearing device 402 is configured to follow the curvature of head 604 and as a result fit the recipient better than conventional BTE hearing devices. BTE hearing device 602 may be configured in a similar manner to BTE hearing device 402 except that BTE hearing device 602 is configured to be worn behind a right ear 606-2 of the recipient. In particular, BTE hearing device 602 is bent in an opposite direction than BTE hearing device 402. In addition, BTE hearing device 602 may have an additional proximal portion and an additional distal portion configured in a manner similar to that described with respect to proximal portion 406 and distal portion 408 shown in FIGS. 4 and 5. For example, the additional proximal portion may have an additional curved shape configured to follow the curvature of a median shape of right ear 606-2. In so doing, BTE hearing device 602 has a side specific structure that is configured to fit right ear 606-2 and follow the curvature on the right side of head 604 of the recipient.

Figure 7:
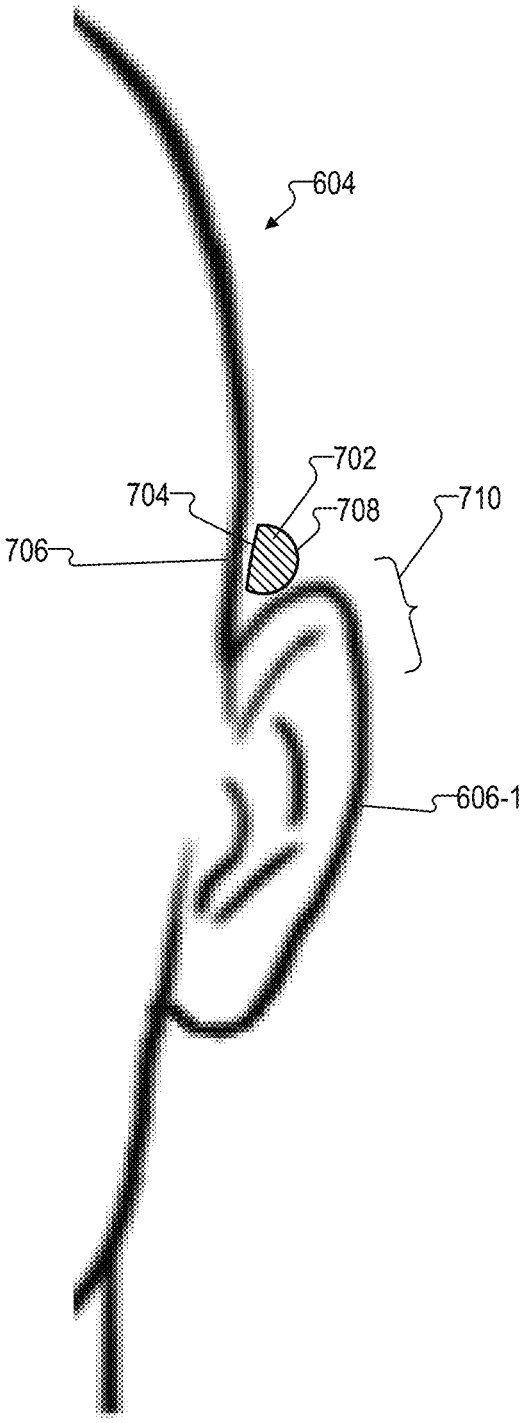
FIG. 7 illustrates a partial front view of a head of a recipient together with a cross-sectional view of an exemplary BTE hearing device that is configured according to principles described herein.

In certain examples, a housing (e.g., housing 404) of a BTE hearing device may have a first side that has a flat surface that is configured to face the skull of the recipient when the BTE hearing device is worn by the recipient and a second side that is configured to face the upper part of the ear of the recipient when the BTE hearing device is worn by the recipient. In certain examples, the second side of the housing may have a curved surface. To illustrate, FIG. 7 shows a partial front view of head 604 of the recipient that is wearing an exemplary BTE hearing device 702. In the example shown in FIG. 7, a cross section of BTE hearing device 702 is illustrated. As shown in FIG. 7, BTE hearing device 702 includes a first side 704 that has a flat surface that is configured to face skull 706 of the recipient. BTE hearing device 702 also includes a second side 708 that is configured to face an upper part 710 of left ear 606-1 and that has a curved surface.

In the example shown in FIG. 7, the cross section is shown as being taken through a proximal portion of BTE hearing device 702. However, it is understood that BTE hearing device 702 may have a similar cross section along all of or any suitable portion of BTE hearing device 702. For example, BTE hearing device 702 may have such a cross section only on the proximal portion (e.g., a portion similar to proximal portion 406) of BTE hearing device 702. Alternatively, BTE hearing device 702 may have such a cross section in both a proximal portion as well as a distal portion (e.g., similar to distal portion 408) of BTE hearing device 702. By having a flat surface on a side of BTE hearing device 702 that faces the recipient, BTE hearing device 702 is configured to lie better on head 604 than conventional BTE hearing devices. In addition, such a configuration results in less interference with the head of the recipient and/or improves the comfortability associated with wearing a BTE hearing device.

In certain alternative examples, the surface of a BTE hearing device that faces the skull of the recipient and the surface of the BTE hearing device that faces an upper portion of the ear of the recipient may both be flat surfaces.

Figure 8:
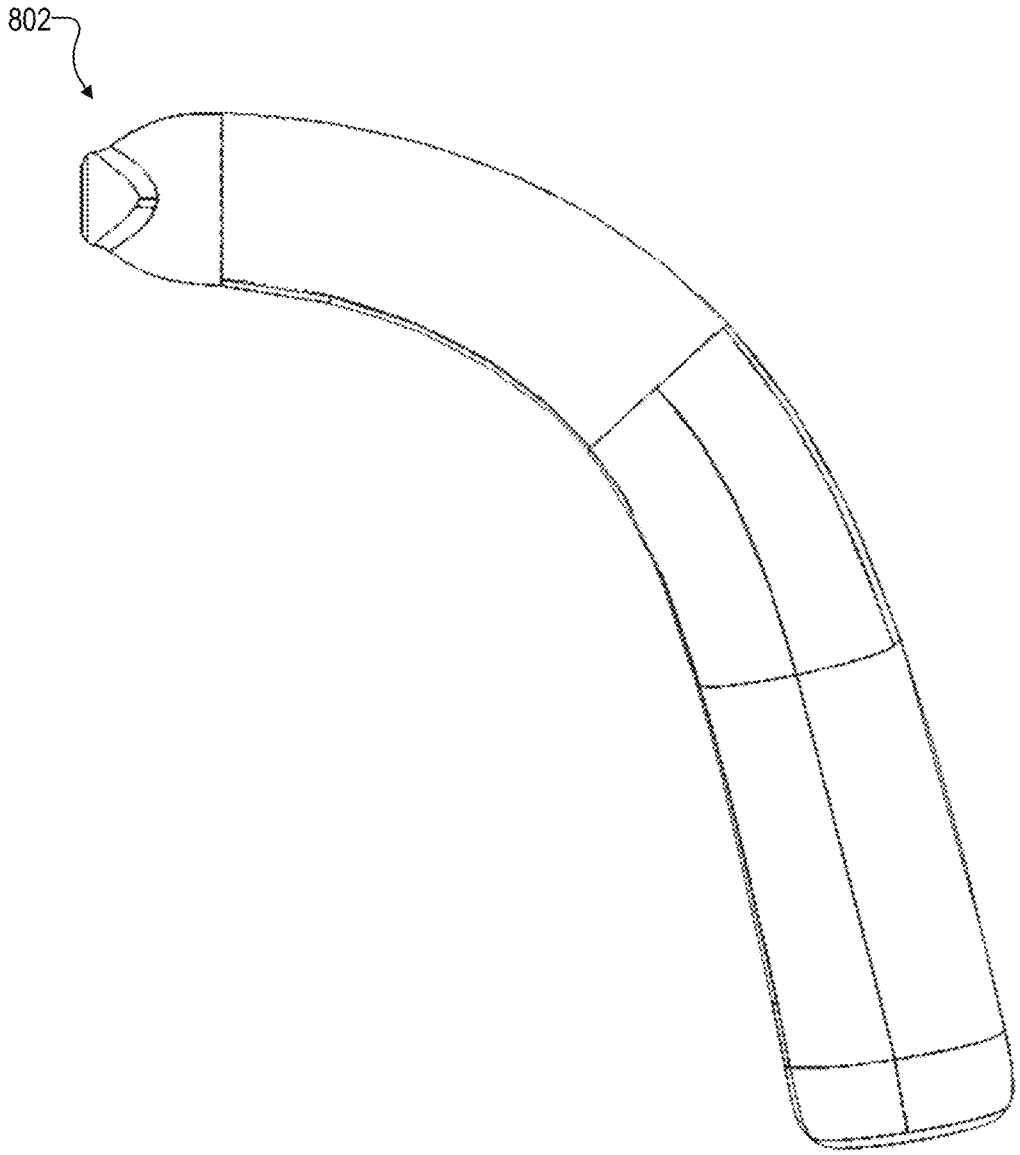
FIGS. 8-12 illustrate different views of an exemplary BTE hearing device that is configured according to principles described herein to be worn behind the left ear of the recipient.

FIGS. 8-12 show various views of an exemplary BTE hearing device 802 that has a side specific structure and is configured to be worn behind a left ear of a recipient. In particular, FIG. 8 shows a left side view of BTE hearing device 802. The side of BTE hearing device 802 shown in FIG. 8 is configured to face an inner side of the left ear of the recipient.

Figure 9:
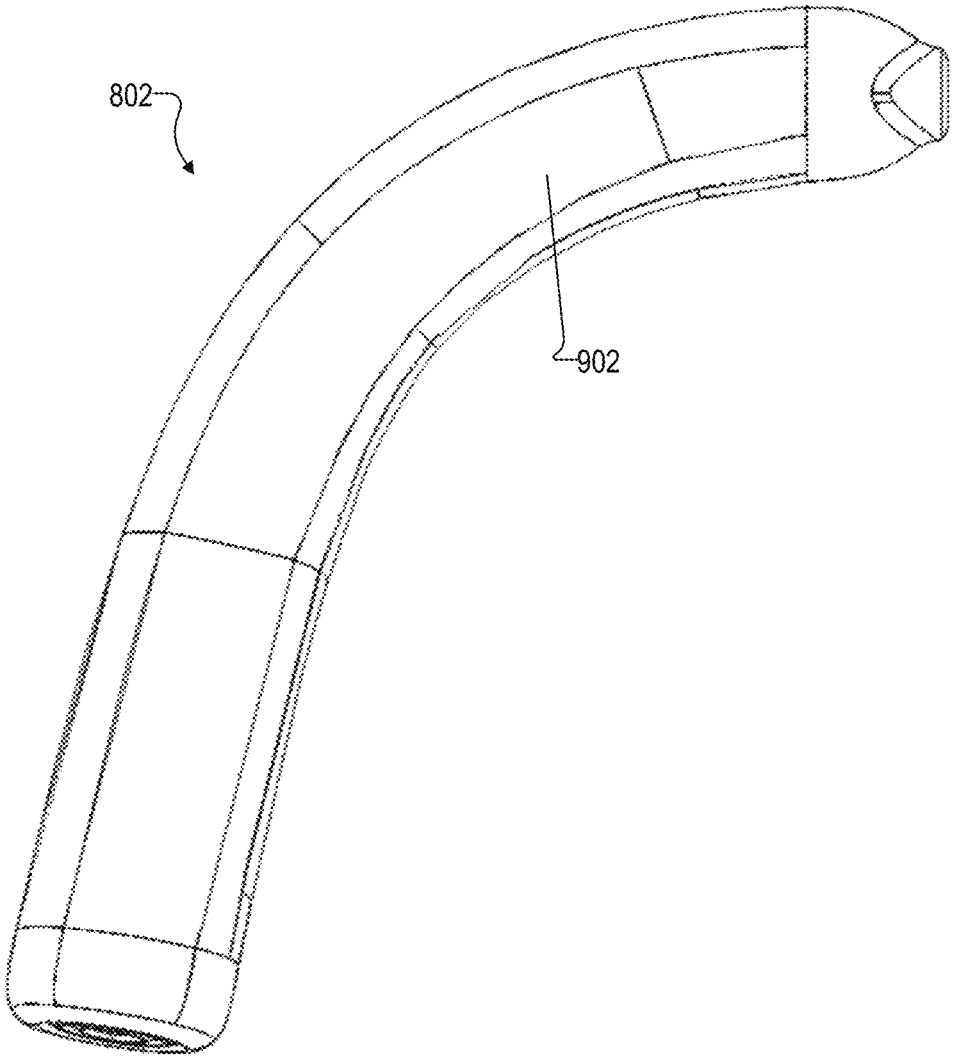

FIG. 9 shows a right side view of BTE hearing device 802. The side of BTE hearing device 802 shown in FIG. 9 is configured to face the head of the recipient. In the example shown in FIG. 9, BTE hearing device 802 includes a flat surface 802 that is provided along substantially the entire side of BTE hearing device 802 shown in FIG. 9.

Figure 10:
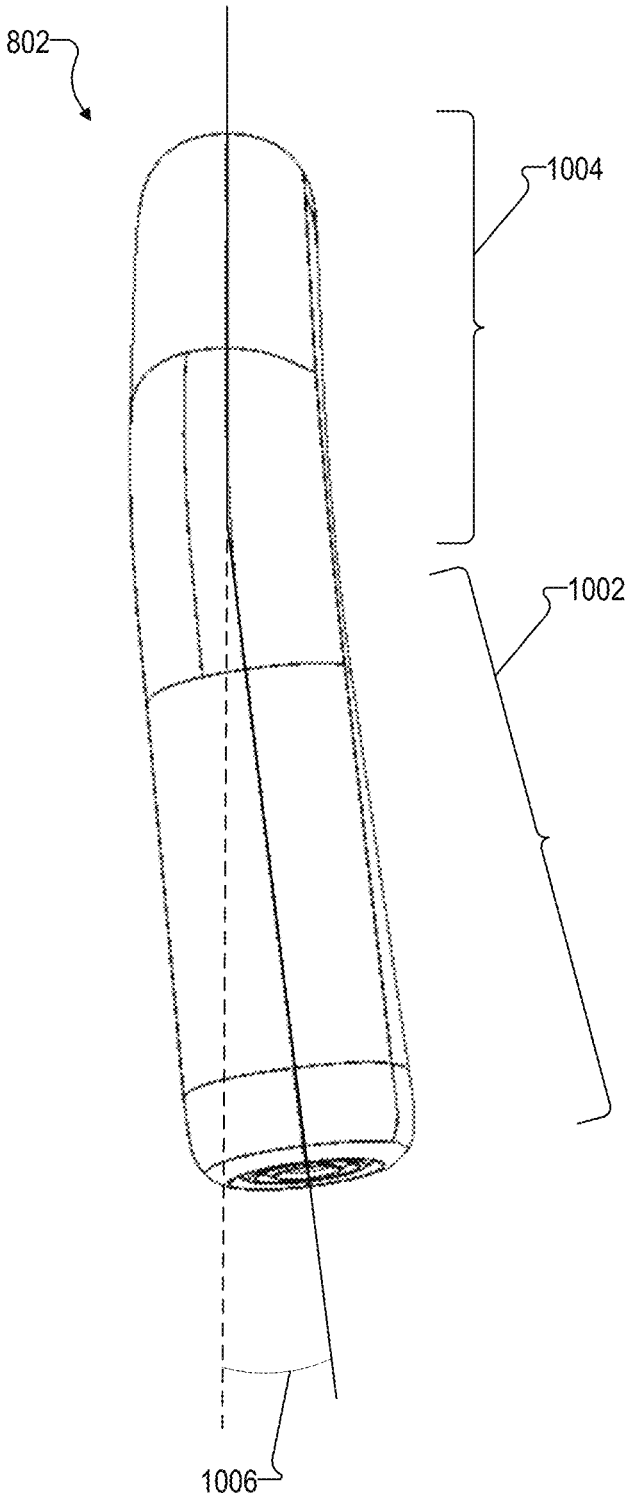

FIG. 10 shows a rear view of BTE hearing device 802. The rear view is the orientation that BTE hearing device 802 would have when viewed from behind the head of the recipient. As shown in FIG. 10, BTE hearing device 802 has a bent configuration where a distal portion 1002 of BTE hearing device 802 is bent with respect to a proximal portion 1004 such that distal portion 1002 is provided at an angle 1006 with respect to proximal portion 1004. In the particular example shown in FIGS. 8-12, it is understood that angle 1006 is 7°.

Figure 11:
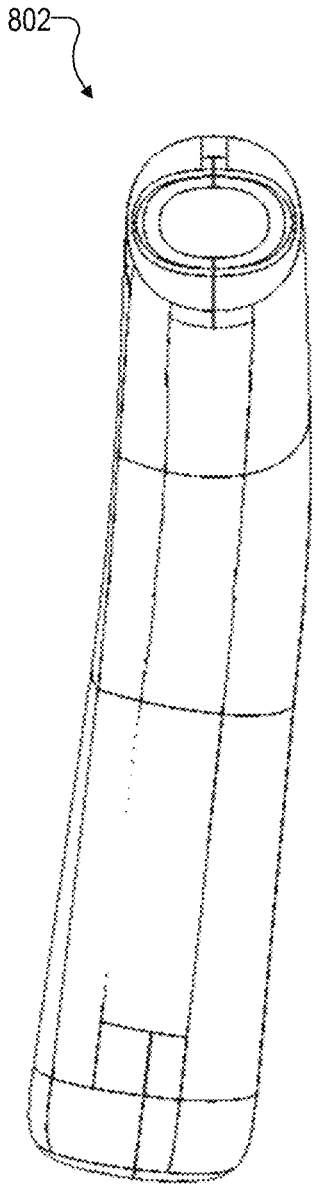

FIG. 11 shows a front view of BTE hearing device 802. The front view is the orientation that BTE hearing device 802 would have when worn by the recipient and the face of the recipient is viewed straight on.

Figure 12:
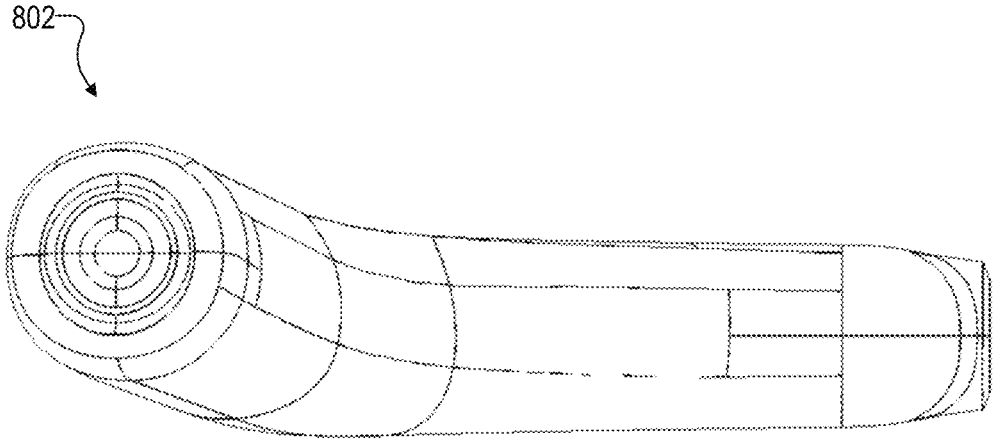

FIG. 12 shows a bottom view of BTE hearing device 802.

Figure 13:
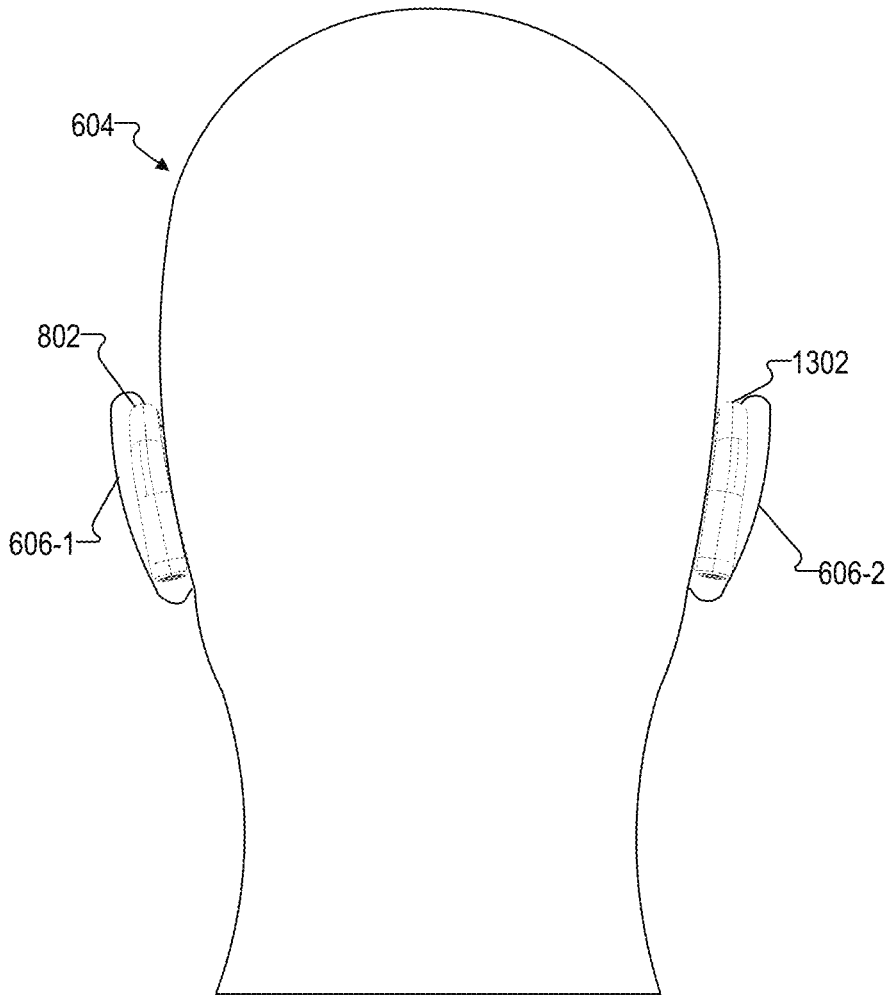
FIG. 13 illustrates a rear view of a head of a recipient that is wearing the exemplary BTE hearing device shown in FIGS. 8-12 and an additional BTE hearing device that is configured according to principles described herein to be worn behind the right ear of the recipient.

FIG. 13 shows a rear view of head 604 of the recipient while the recipient is wearing BTE hearing device 802 and an additional BTE hearing device 1302. As shown in FIG. 13, BTE hearing device 802 is worn behind left ear 606-1 of the recipient and BTE hearing device 1302 is worn behind right ear 606-2. BTE hearing device 1302 may be configured in a manner similar to BTE hearing device 802 except that BTE hearing device 1302 is configured to be worn behind right ear 606-2 of the recipient. In particular, BTE hearing device 1302 is bent in an opposite direction than BTE hearing device 802. In addition, BTE hearing device 1302 has a curvature that follows a median shape of right ear 606-2. In so doing, BTE hearing device 1302 has a side specific structure that is configured to fit behind right ear 606-2 and follow the curvature on the right side of the head of the recipient.

Figure 14:
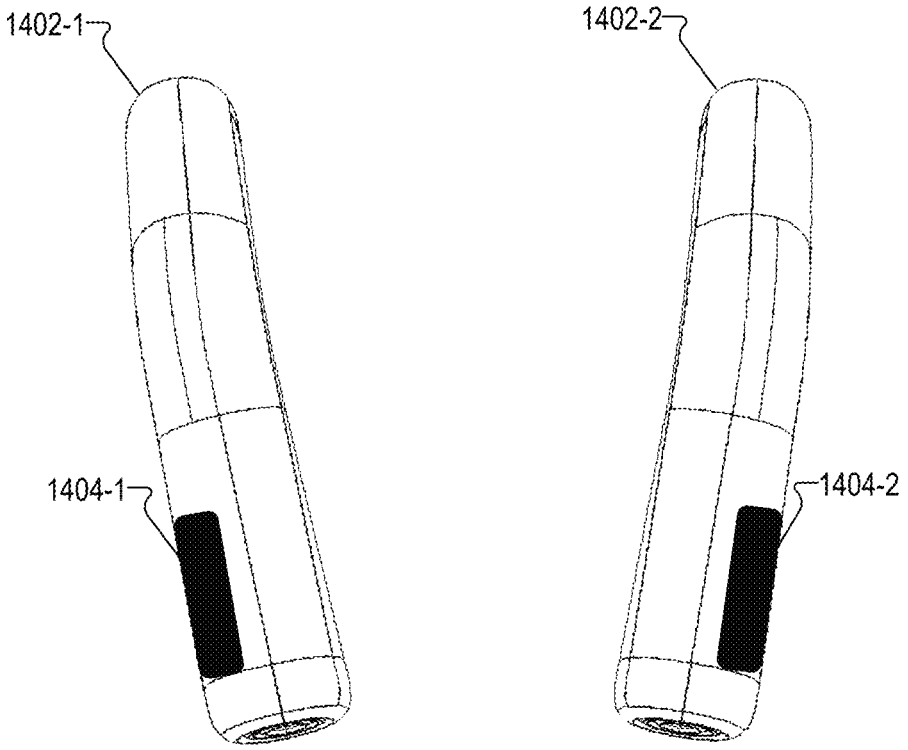
FIG. 14 illustrates rear views of exemplary left side and right side BTE hearing devices that include asymmetrically positioned control interfaces according to principles described herein.

In certain examples, the side specific structure of a BTE hearing device may further include an asymmetrically positioned control interface (e.g., a push button) that is configured to control operation of the BTE hearing device. To illustrate, FIG. 14 shows a rear view of exemplary BTE hearing devices 1402 (e.g., BTE hearing devices 1402-1 and 1402-2) that each include a control interface 1404 (e.g., control interfaces 1404-1 and 1404-2). As shown in FIG. 14, BTE hearing device 1402-1 has a side specific structure and is configured to be worn behind the left ear of a recipient. Control interface 1404-1 is positioned asymmetrically towards a left side of BTE hearing device 1402-1 in FIG. 14 to facilitate the recipient accessing control interface 1404-1 from the left side of the recipient. On the other hand, BTE hearing device 1402-2 has a side specific structure and is configured to be worn behind the right ear of the recipient. As such, control interface 1404-2 is asymmetrically positioned towards a right side of BTE hearing device 1402-2 in FIG. 14 to facilitate the recipient accessing control interface 1404-2 from the right side of the recipient.

Although FIG. 14 shows control interfaces 1404-1 and 1404-2 as being positioned towards respective distal ends of BTE hearing devices 1402-1 and 1402-2, it is understood that control interfaces 1404-1 and 1404-2 may be provided in other asymmetrical positions in other implementations. For example, control interface 1404-1 may be provided on the left side of a proximal end (e.g., towards the top) of BTE hearing device 1402-1 shown in FIG. 14 in certain implementations.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A behind-the-ear ("BTE") hearing device having a side specific structure, the BTE hearing device comprising:

a housing comprising:

a proximal portion configured to be positioned towards an upper part of an ear of a recipient, the proximal portion having a curved shape configured to curve within a first reference plane such that the proximal portion is configured to follow a median shape of the ear when the BTE hearing device is worn by the recipient;

a distal portion configured to extend behind the ear when the BTE hearing device is worn by the recipient, the distal portion configured to extend within a second reference plane that intersects the first reference plane at an angle such that the distal portion is bent with respect to the proximal portion and is configured to extend toward a skull of the recipient when the BTE hearing device is worn by the recipient; and a control interface that is asymmetrically positioned with respect to the second reference plane and that is provided on a side of the housing that faces away from the recipient when the BTE hearing device is worn by the recipient; and one or more electrical components disposed within the distal portion of the housing, wherein:

the distal portion of the housing is formed of a deformable material configured to bend and remain in a position such that the angle at which the distal portion is bent with respect to the proximal portion is repeatably adjustable; and the housing further comprises:

a first side that is configured to face the skull of the recipient when the BTE hearing device is worn by the recipient, the first side having a flat surface only on the proximal portion of the housing and a curved surface on the distal portion of the housing; and a second side that is configured to face the upper part of the ear of the recipient when the BTE hearing device is worn by the recipient.

2. The BTE hearing device of claim 1, wherein the second side of the housing has an additional curved surface.

3. The BTE hearing device of claim 1, wherein the angle at which the distal portion is bent with respect to the proximal portion is adjustable within a range that is greater than 0° and less than 20°.

4. The BTE hearing device of claim 1, wherein the angle at which the distal portion of the housing is bent with respect to the proximal portion of the housing is less than 10°.

5. A behind-the-ear ("BTE") hearing device having a side specific structure, the BTE hearing device comprising:

a housing comprising:

a proximal portion configured to be positioned towards an upper part of an ear of a recipient, the proximal portion having a curved shape configured to curve within a first reference plane such that the proximal portion is configured to follow a median shape of the ear when the BTE hearing device is worn by the recipient;

a distal portion configured to extend behind the ear when the BTE hearing device is worn by the recipient, the distal portion configured to extend within a second reference plane that intersects the first reference plane at a non-zero angle;

a bendable portion where the distal portion of the housing is configured to bend with respect to the proximal portion of the housing such that an angle at which the distal portion is bent with respect to the proximal portion is repeatably adjustable; and a control interface that is asymmetrically positioned with respect to the second reference plane and that is provided on a side of the housing that faces away from the recipient when the BTE hearing device is worn by the recipient; and one or more electrical components disposed within the distal portion of the housing, wherein the housing further comprises:

a first side that is configured to face the skull of the recipient when the BTE hearing device is worn by the recipient, the first side having a flat surface only on the proximal portion of the housing and a curved surface on the distal portion of the housing; and a second side that is configured to face the upper part of the ear of the recipient when the BTE hearing device is worn by the recipient.

6. The BTE hearing device of claim 5, wherein the second side of the housing has an additional curved surface.

7. The BTE hearing device of claim 5, wherein the bendable portion is formed of a deformable material that is configured to bend and remain in a position at the angle at which the distal portion is bent with respect to the proximal portion.

8. The BTE hearing device of claim 7, wherein the distal portion of the housing is bendable with respect to the proximal portion of the housing such that the angle is within a range that is greater than 0° and less than 20°.

9. A binaural hearing system comprising:

a first behind-the-ear ("BTE") hearing device configured to be worn behind a left ear of a recipient, the first BTE hearing device comprising a first housing comprising:

a proximal portion configured to be positioned towards an upper part of the left ear, the proximal portion of the first housing having a curved shape configured to curve within a first reference plane such that the proximal portion is configured to follow a median shape of the left ear when the first BTE hearing device is worn by the recipient;

a distal portion configured to extend behind the left ear when the first BTE hearing device is worn by the recipient, the distal portion of the first housing configured to extend within a second reference plane that intersects the first reference plane at an angle such that the distal portion is bent with respect to the proximal portion and is configured to extend toward a skull of the recipient when the first BTE hearing device is worn by the recipient;

a first control interface that is asymmetrically positioned with respect to the second reference plane and that is provided on a side of the first housing that faces away from the recipient when the first BTE hearing device is worn by the recipient; and one or more electronic components disposed in the distal portion of the first housing; and a second BTE hearing device configured to be worn behind a right ear of the recipient, the second BTE hearing device comprising a second housing comprising:

an additional proximal portion configured to be positioned towards an upper part of the right ear, the additional proximal portion of the second housing having an additional curved shape that is configured to curve within a third reference plane such that the additional proximal portion is configured to follow a median shape of the right ear when the second BTE hearing device is worn by the recipient;

an additional distal portion configured to extend behind the right ear when the second BTE hearing device is worn by the recipient, the additional distal portion of the second housing extends within a fourth reference plane that intersects the third reference plane at an additional angle such that the distal portion is bent with respect to the proximal portion and is configured to extend toward the skull of the recipient when the second BTE hearing device is worn by the recipient; and a second control interface that is asymmetrically positioned with respect to the fourth reference plane and that is provided on a side of the second housing that faces away from the recipient when the second BTE hearing device is worn by the recipient; and one or more additional electronic components disposed in the additional distal portion of the second housing, wherein:

the distal portion of the first housing is formed of a deformable material configured to bend and remain in a position such that the angle at which the distal portion is bent with respect to the proximal portion is repeatably adjustable;

the additional distal portion of the second housing is formed of the deformable material configured to bend and remain in an additional position such that the additional angle at which the additional distal portion is bent with respect to the additional proximal portion is repeatably adjustable; and the first housing further comprises:

a first side that is configured to face the skull of the recipient when the first BTE hearing device is worn by the recipient, the first side having a flat surface only on the proximal portion of the housing and a curved surface on the distal portion of the housing; and a second side that is configured to face the upper part of the left ear of the recipient when the first BTE hearing device is worn by the recipient.

10. The binaural hearing system of claim 9, wherein the second side of the first housing has an additional curved surface.

11. The binaural hearing system of claim 9, wherein the second housing further comprises:

a third side that has an additional flat surface that is configured to face the skull of the recipient when the second BTE hearing device is worn by the recipient; and a fourth side that is configured to face the upper part of the right ear of the recipient when the second BTE hearing device is worn by the recipient.

12. The binaural hearing system of claim 11, wherein the fourth side of the second housing has an additional curved surface.

13. The binaural hearing system of claim 9, wherein:

the curved shape of the proximal portion of the first BTE hearing device matches the median shape of the left ear of the recipient; and the additional curved shape of the additional proximal portion of the second BTE hearing device matches the median shape of the right ear of the recipient.

14. The binaural hearing system of claim 9, wherein:

the distal portion of the first housing is bendable with respect to the proximal portion of the first housing such that the angle is within a range that is greater than 0° and less than 20°; and the additional distal portion of the second housing is bendable with respect to the additional proximal portion of the second housing such that the additional angle is within a range that is greater than 0° and less than 20°.

15. The binaural hearing system of claim 9, wherein:

the angle at which the distal portion of the first housing is bent with respect to the proximal portion of the first housing is less than 10°; and the additional angle at which the additional distal portion of the second housing is bent with respect to the additional proximal portion of the second housing is less than 10°.

* * * * *